United States Patent [19]

Hans et al.

[11] 4,007,880

[45] Feb. 15, 1977

[54] ELECTROMAGNETIC FUEL INJECTION VALVE

[75] Inventors: Waldemar Hans, Bamberg; Herbert Wagner, Mellrichstadt, both of Germany

[73] Assignee: Robert Bosch G.m.b.H., Stuttgart, Germany

[22] Filed: Dec. 3, 1975

[21] Appl. No.: 637,147

[30] Foreign Application Priority Data

Dec. 12, 1974 Germany ..... 2458728

[52] U.S. Cl. ..... 239/585; 29/511; 239/600

[51] Int. Cl.[2] ..... B05B 1/30

[58] Field of Search ..... 239/584, 585, 600; 29/156.7 R, 511

[56] References Cited

UNITED STATES PATENTS

| | | | |
|---|---|---|---|
| 3,139,785 | 7/1964 | Harwood | 29/511 X |
| 3,439,876 | 4/1969 | Shook | 239/584 X |
| 3,442,491 | 5/1969 | Messerschmidt | 29/510 X |
| 3,828,247 | 8/1974 | Kirsch et al. | 73/119 A X |

*Primary Examiner*—Evon C. Blunk
*Assistant Examiner*—Michael Mar
*Attorney, Agent, or Firm*—Edwin E. Greigg

[57] ABSTRACT

An electromagnetically actuated fuel injection valve includes a coaxial assembly of a connection tube, a bushing, a housing extension and a nozzle body. All seals between adjacent faces and edges of these elements are age-resistant metal-to-metal seals. The seal between the housing extension and the nozzle body is formed by pressing the overlapping end of the housing extension over annular edges on the nozzle body. The remaining seals are welds or solder-joints.

4 Claims, 1 Drawing Figure

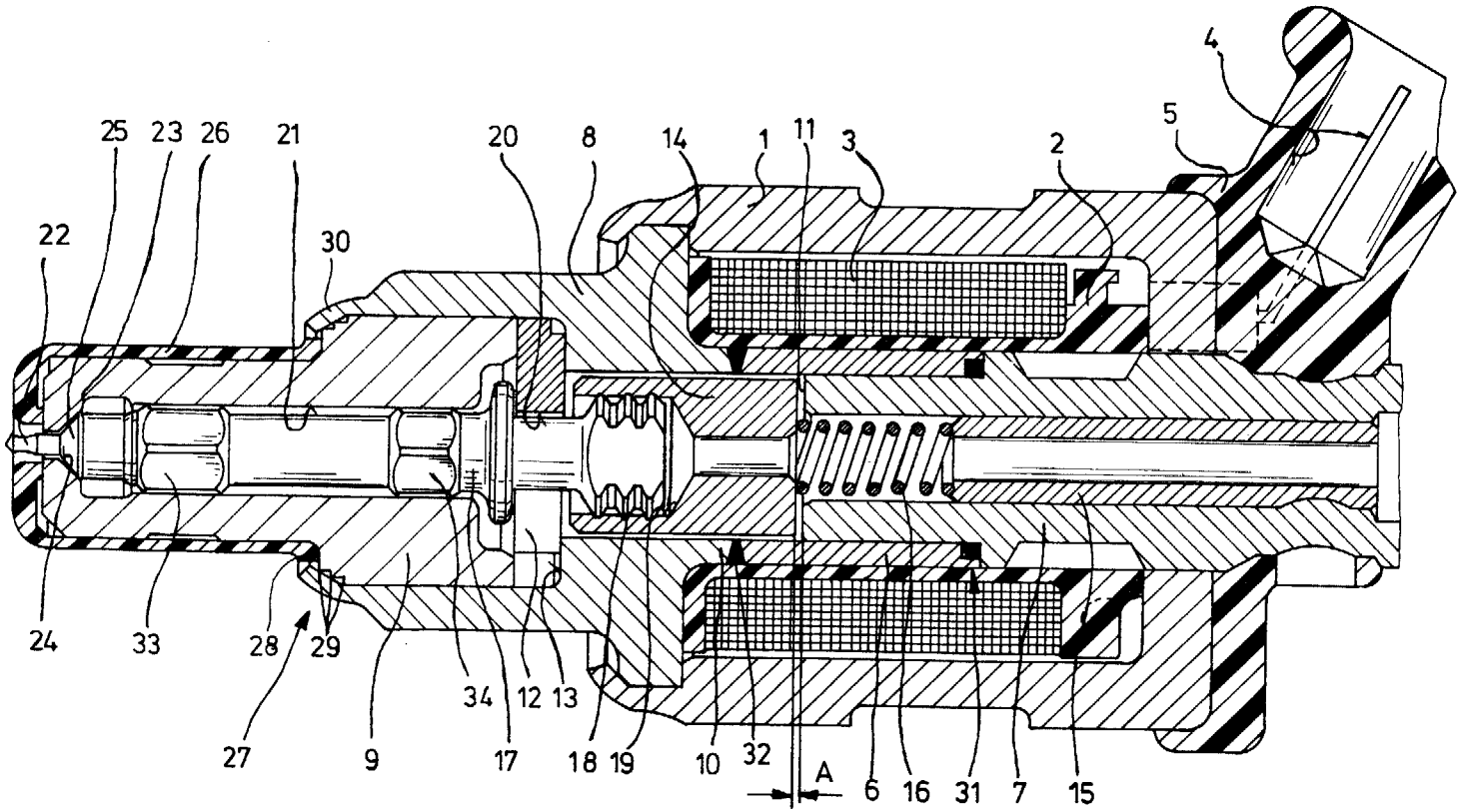
4
5
2
3
11
1
14
8
20
30
21
26
23
25
22
15
7
31
16
6
A
32
10
19
18
13
12
17
34
9
29
28
27
33
24

ELECTROMAGNETIC FUEL INJECTION VALVE

BACKGROUND OF THE INVENTION

The invention relates to an electromagnetic periodically actuated injection valve for low pressure fuel injection systems of internal combustion engines. The fuel injection valve is used with induction tube injection and includes a housing, a locally fixed magnetic winding carried by an iron core and a coaxial movable armature. The armature, in turn, carries a valve needle which is guided within the nozzle body and is suitably fastened within the armature.

Valves of the type described above commonly use rubber seals, usually O-rings, to seal off those portions of the valve housing which carry fuel from the exterior. However, these valves are normally installed in the induction manifold of internal combustion engines and thus are subjected to very high temperature loads; the local temperatures may vary between −30° C and +130° C. Rubber or other elastic sealing elements cannot sustain such temperature loading for a very long time. Aging, shrinking and hardening, as well as the leaching of the softening agents by the aromatic components of gasoline soon lead to defective sealing properties of such rubber seals. The fuel lines are usually under a pressure of 2 to 3 bar so that fuel can leak from improperly sealed points of the valve into the engine compartment and may lead to a fire.

OBJECT AND SUMMARY OF THE INVENTION

It is a principal object of the invention to provide an injection valve in which the disadvantage of improper and effective seals is avoided.

This object is attained, according to the invention, by providing an injection valve in which all seals are metal-to-metal seals.

The invention will be better understood as well as further objects and advantages thereof become more apparent from the following detailed description of a preferred embodiment taken in conjunction with the drawing.

BRIEF DESCRIPTION OF THE DRAWING

The single FIGURE of the drawing is a cross section through a fuel injection valve according to the invention.

DESCRIPTION OF THE PREFERRED EMBODIMENT

A fuel injection valve has a valve housing 1 in which are located a coil carrier 2 and a magnetic coil 3. Electric current is carried to the magnetic coil 3 through a plug connection 4 embedded in a plastic ring 5.

Within the magnetic coil 3 there is disposed a non-magnetic bushing 6 one of whose ends is welded or soldered to a connection tube 7 through which gasoline is admitted to the valve and its other end is connected in the same manner with a housing extension 8 forming part of the valve housing 1. The housing extension 8 has a cylindrical collar 10 whose inside and outside diameters are the same as those of the non-magnetic bushing 6 so that the seal between the two members is smooth on both the inside and the outside.

An arresting plate 12 of a particular thickness chosen for the exact adjustment of the valve, rests on an interior shoulder 13 of the housing extension 8. Disposed between this arresting plate 12 and an axial end face of the connection tube 7 is located an armature 14 of the magnetic valve. The armature 14 consists of a corrosion resistant material. Coaxially with and inside of an interior bore of the connection tube 7 lies a tube insert 15 which is fastened therein by crimping. A compression spring 16 is located within the bore of the connection tube 7 and between an end face of the tube insert 15 and an end face of the armature 14 and tends to move the armature away from the connection tube 7. A valve needle 17 equipped with annular lands and grooves 18 is press-fit in a bore 19 on the opposite end of the armature 14.

The valve needle 17 penetrates with clearance a bore 20 within the arresting plate 12 and a further bore 21 within the nozzle body 9 and its tip 22 extends out of the nozzle body 9. An interior shoulder 23 of the nozzle body has a conical valve seat surface 24 which cooperates with an exterior conical surface 25 on the valve needle 17, thereby forming the fuel injection valve 24/25. Surrounding the nozzle body 9 and the needle tip 22 is a protective sleeve 26, made of plastic and press-fit onto the nozzle body 9. The length of the valve needle 17 and of the armature 14 is so chosen that, when the valve is not actuated, a clearance A obtains between its upper face and the face 11 of the connection tube 7.

A seal 27 is formed near an exterior shoulder 28 of the nozzle body by providing the nozzle body 9 with three annular edges 29 which are engaged by the outer edge 30 of the housing extension 8 which is pressed over them by a suitable tool, for example a crimping or roller tool. In this process, the sealing edges 29 embed themselves into the interior wall of the housing extension 8, thereby forming a reliable metal-to-metal seal.

Two further seals 31 and 32 of the injection valve are provided at the respective ends of the non-magnetic sleeve 6. These seals are also metal-to-metal seals and thus are reliable and age-resistant. These seals 31 and 32 are formed either by welding or by soldering or, again, by the insertion of soft iron or copper ring seals. Due to this construction, even very high temperature loads cannot affect the seals detrimentally. The fuel injection valve remains tight at all times and no fuel can leak into the engine compartment so that fires due to leaking fuel cannot occur.

In order to prevent the formation of corrosion in the valve which might affect the seals, the valve is so constructed that all interior portions of it are bathed by fuel. According to the invention, this is done by providing a valve needle 17 without an axial bore as has been the custom, but rather with two sets of quadruple flats 33 and 34 which provide guidance for the needle within the bore 21 and also provide an axial passage for the fuel. In this manner, the fuel flows from the direction of the armature 14 through the radial clearance between the bore 20 and the needle 17 and over the exterior surface of the valve needle 17. In this manner, the entire exterior surface of the valve needle is bathed by flowing fuel.

What is claimed is:

1. In an electromagnetic fuel injection valve for timed low-pressure fuel injection systems, which valve includes a coaxial assembly of a connection tube, a bushing, a housing extension and a fuel nozzle body, said assembly forming a substantially cylindrical passage for fuel to be delivered by said valve to an engine, the improvement comprising metallic seals between adjacent portions of said connection tube and said bushing, and between said bushing and said housing extension, said metallic seals having their surfaces in engagement with their corresponding adjacent elements under pressure, and a further metallic seal between said housing extension and said nozzle body, said further metallic seal being formed by parallel edges on said nozzle body which mate with an interior portion of said housing extension, and under external pressure embed themselves into the wall defining the interior portion of said housing extension.

2. A fuel injection valve as claimed in claim 1, wherein said bushing is a non-magnetic bushing disposed coaxially within the magnetic windings of said electromagnetic valve.

3. A fuel injection valve as claimed in claim 1, further including an armature, slidably disposed within a bore of said housing extension and a valve needle, fixedly and coaxially attached to said armature, the improvement further comprising said valve needle having a square transverse cross section in at least two separate locations; whereby fuel may flow over the flat exterior surfaces of said locations and over the remaining exterior surface of said valve needle.

4. A fuel injection valve as claimed in claim 1, wherein the metallic seals between adjacent portions of said connection tube and said bushing and between said bushing and said housing extension also serve to bond their respective adjacent elements to each other.

* * * * *